US008181478B2

(12) United States Patent
Ignatiev

(10) Patent No.: US 8,181,478 B2
(45) Date of Patent: May 22, 2012

(54) REFRIGERATION SYSTEM

(75) Inventor: Kirill Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 274 days.

(21) Appl. No.: 11/541,951

(22) Filed: Oct. 2, 2006

(65) Prior Publication Data

US 2008/0078204 A1 Apr. 3, 2008

(51) Int. Cl.

| | |
|---|---|
| ***F25B 43/02*** | (2006.01) |
| ***F25B 31/00*** | (2006.01) |
| ***F25B 43/00*** | (2006.01) |
| ***F25B 41/00*** | (2006.01) |

(52) U.S. Cl. ..... 62/468; 62/470; 62/473; 62/512; 62/513; 62/505

(58) Field of Classification Search ..... 62/470, 62/473, 501, 502, 512, 513, 468, 505
See application file for complete search history.

(56) References Cited

U.S. PATENT DOCUMENTS

| | | | |
|---|---|---|---|
| 2,697,334 | A | 12/1954 | Clarke |
| 2,820,350 | A | 1/1958 | Sheets |
| 3,738,780 | A | 6/1973 | Edstrom |
| 3,795,117 | A | 3/1974 | Moody, Jr. et al. |
| 3,811,291 | A | 5/1974 | Schibbye |
| 3,885,402 | A | 5/1975 | Moody, Jr. et al. |
| 3,913,346 | A | 10/1975 | Moody, Jr. et al. |
| 3,996,745 | A | 12/1976 | Davoud et al. |
| 4,005,949 | A | 2/1977 | Grant |
| 4,062,199 | A | 12/1977 | Kasahara et al. |
| 4,196,594 | A | 4/1980 | Abom |
| 4,316,366 | A | 2/1982 | Manning |
| 4,419,865 | A | 12/1983 | Szymaszek |
| 4,509,341 | A | 4/1985 | Zimmern |
| 4,545,742 | A | 10/1985 | Schaefer |
| 4,702,086 | A | 10/1987 | Nunn, Sr. et al. |
| 4,727,725 | A | 3/1988 | Nagata et al. |
| 4,861,246 | A | 8/1989 | Zimmern |

(Continued)

FOREIGN PATENT DOCUMENTS

EP 1 492 986 B1 11/2007

(Continued)

OTHER PUBLICATIONS

P. Neksa, "CO2 As Refrigerant for Systems in Transcritical Operation Principles and Technology Status," Sep. 2004, EcoLibrium, pp. 1-6.*

(Continued)

*Primary Examiner* — Frantz Jules
*Assistant Examiner* — Cassey D Bauer
(74) *Attorney, Agent, or Firm* — Harness, Dickey & Pierce, P.L.C.

(57) ABSTRACT

A refrigeration system can incorporate a liquid-injection system that can provide a cooling liquid to an intermediate-pressure location of the compressor. The cooling liquid can absorb the heat of compression during the compression of the refrigerant flowing therethrough. The refrigeration system can include an economizer circuit that injects a refrigerant vapor into an intermediate-pressure location of the compressor in conjunction with the injection of the cooling liquid. The incorporation of the vapor injection in conjunction with the cooling-liquid injection can advantageously increase the cooling capacity and/or efficiency of the refrigeration system and the performance of the compressor.

33 Claims, 4 Drawing Sheets

U.S. PATENT DOCUMENTS

| | | | | |
|---|---|---|---|---|
| 4,877,382 | A | | 10/1989 | Caillat et al. |
| 4,889,471 | A | * | 12/1989 | Izunaga et al. ..... 417/32 |
| 4,899,555 | A | | 2/1990 | Shaw |
| 4,903,497 | A | | 2/1990 | Zimmern et al. |
| 4,947,655 | A | | 8/1990 | Shaw |
| 4,959,972 | A | | 10/1990 | Lowes |
| 4,974,427 | A | | 12/1990 | Diab |
| 5,079,930 | A | | 1/1992 | Beaverson et al. |
| 5,095,712 | A | | 3/1992 | Narreau |
| 5,217,360 | A | * | 6/1993 | Kawahara et al. ..... 418/55.5 |
| 5,410,889 | A | * | 5/1995 | Sjoholm et al. ..... 62/160 |
| 5,447,420 | A | | 9/1995 | Caillat et al. |
| 5,457,966 | A | | 10/1995 | Nivens |
| 5,475,985 | A | | 12/1995 | Heinrichs et al. |
| 5,582,022 | A | | 12/1996 | Heinrichs et al. |
| 5,678,987 | A | | 10/1997 | Timuska |
| 5,996,364 | A | | 12/1999 | Lifson et al. |
| 6,021,645 | A | | 2/2000 | Hara |
| 6,032,472 | A | | 3/2000 | Heinrichs et al. |
| 6,058,727 | A | * | 5/2000 | Fraser et al. ..... 62/190 |
| 6,105,378 | A | | 8/2000 | Shaw |
| 6,167,722 | B1 | | 1/2001 | Kasezawa et al. |
| 6,231,324 | B1 | | 5/2001 | Clendenin et al. |
| 6,257,840 | B1 | | 7/2001 | Ignatiev et al. |
| 6,350,111 | B1 | | 2/2002 | Perevozchikov et al. |
| 6,374,631 | B1 | | 4/2002 | Lifson et al. |
| 6,385,981 | B1 | | 5/2002 | Vaisman |
| 6,428,296 | B1 | | 8/2002 | Elson et al. |
| 6,571,576 | B1 | | 6/2003 | Lifson et al. |
| 6,581,397 | B1 | | 6/2003 | Taira et al. |
| 6,694,750 | B1 | | 2/2004 | Lifson et al. |
| 6,945,073 | B2 | | 9/2005 | Matsumoto et al. |
| 7,013,664 | B2 | | 3/2006 | Matsumoto |
| 7,076,968 | B2 | | 7/2006 | Matsumoto |
| 7,101,162 | B2 | | 9/2006 | Matsumoto |
| 7,204,099 | B2 | | 4/2007 | Lifson et al. |
| 7,647,790 | B2 | | 1/2010 | Ignatiev et al. |
| 2002/0139136 | A1 | | 10/2002 | Noble |
| 2002/0187064 | A1 | | 12/2002 | Vigano et al. |
| 2005/0044885 | A1 | | 3/2005 | Pearson |
| 2005/0089432 | A1 | | 4/2005 | Truyens et al. |

FOREIGN PATENT DOCUMENTS

| | | |
|---|---|---|
| KR | 10-0153441 | 1/1999 |

OTHER PUBLICATIONS

McGraw-Hill Dictionary of Scientific and Technical Terms, 4th ed. 1989. p. 728-729.*

Theodore Baumeister, "Marks' Mechanical Engineers' Handbook" 6th ed. Published by McGraw-Hill Book Company, Inc. 1958. p. 4-67.*

International Search Report regarding International Application No. PCT/US2007/021129 Written Opinion of the International Searching Authority regarding International Application No. PCT/US2007/021129.

Compressor Handbook, Paul C. Hanlon, 2001, McGraw-Hill, pp. 2.3-2.4 and 12.2-12.4.

Marks' Standard Handbook for Mechanical Engineers, Eugene A. Avallone and Theodore Baumeister, 10th edition, 1996, McGraw-Hill, pp. 19.1 and 19.5.

Notification of First Office Action regarding Chinese Patent Application No. 200780036843.5 received from the State Intellectual Property Office of People's Republic of China dated Jul. 7, 2010. Translation provided by Unitalen Attorneys at Law.

Office Action regarding U.S. Appl. No. 12/644,726, mailed Feb. 23, 2011.

United States Office Action regarding U.S. Appl. No. 11/865,706, mailed Jan. 25, 2011.

* cited by examiner

REFRIGERATION SYSTEM

FIELD

The present teachings relate generally to refrigeration systems and, more particularly, to refrigeration systems with liquid injection.

BACKGROUND AND SUMMARY

The statements in this section merely provide background information related to the present teachings and may not constitute prior art.

Compressors are utilized to compress refrigerant for refrigeration systems, such as air conditioning, refrigeration, etc. During the compression of the refrigerant within the compressor, a significant quantity of heat can be generated. This heat can result in the temperature of the discharged refrigerant being excessively high. A reduction in the discharge temperature of the refrigerant can increase the cooling capacity of the refrigeration system. Additionally, a reduction of the compression heat can increase the efficiency of the compressor. Thus, it would be advantageous to reduce the temperature during the compression process. Furthermore, it would be advantageous to reduce the temperature of the discharged refrigerant exiting the compressor. It would be even more advantageous if the refrigerant compression approached quasi-isothermal compression.

A refrigeration system according to the present teachings can incorporate a liquid-injection system that provides a cooling liquid to an intermediate-pressure location of the compressor. The cooling liquid can absorb the heat of compression during the compression of the refrigerant flowing therethrough. The cooling liquid can be externally separated from the refrigerant flow and injected back into the intermediate-pressure location. The cooling liquid can thereby advantageously decrease the temperature of the compression process and the temperature of the refrigerant being discharged by the compressor. The liquid-injection system can result in an increased cooling capacity and/or an increased efficiency for the refrigeration system.

A refrigeration system according to the present teachings can also include vapor injection of a refrigerant flow into an intermediate-pressure location of the compressor through an economizer circuit. The incorporation of the vapor injection in conjunction with the cooling-liquid injection can advantageously increase the cooling capacity and/or efficiency of the refrigeration system and the performance of the compressor.

Further areas of applicability will become apparent from the description provided herein. It should be understood that the description and specific examples are intended for purposes of illustration only and are not intended to limit the scope of the present claims.

DRAWINGS

The drawings described herein are for illustration purposes only and are not intended to limit the scope of the present teachings in any way.

DETAILED DESCRIPTION

Figure 1:
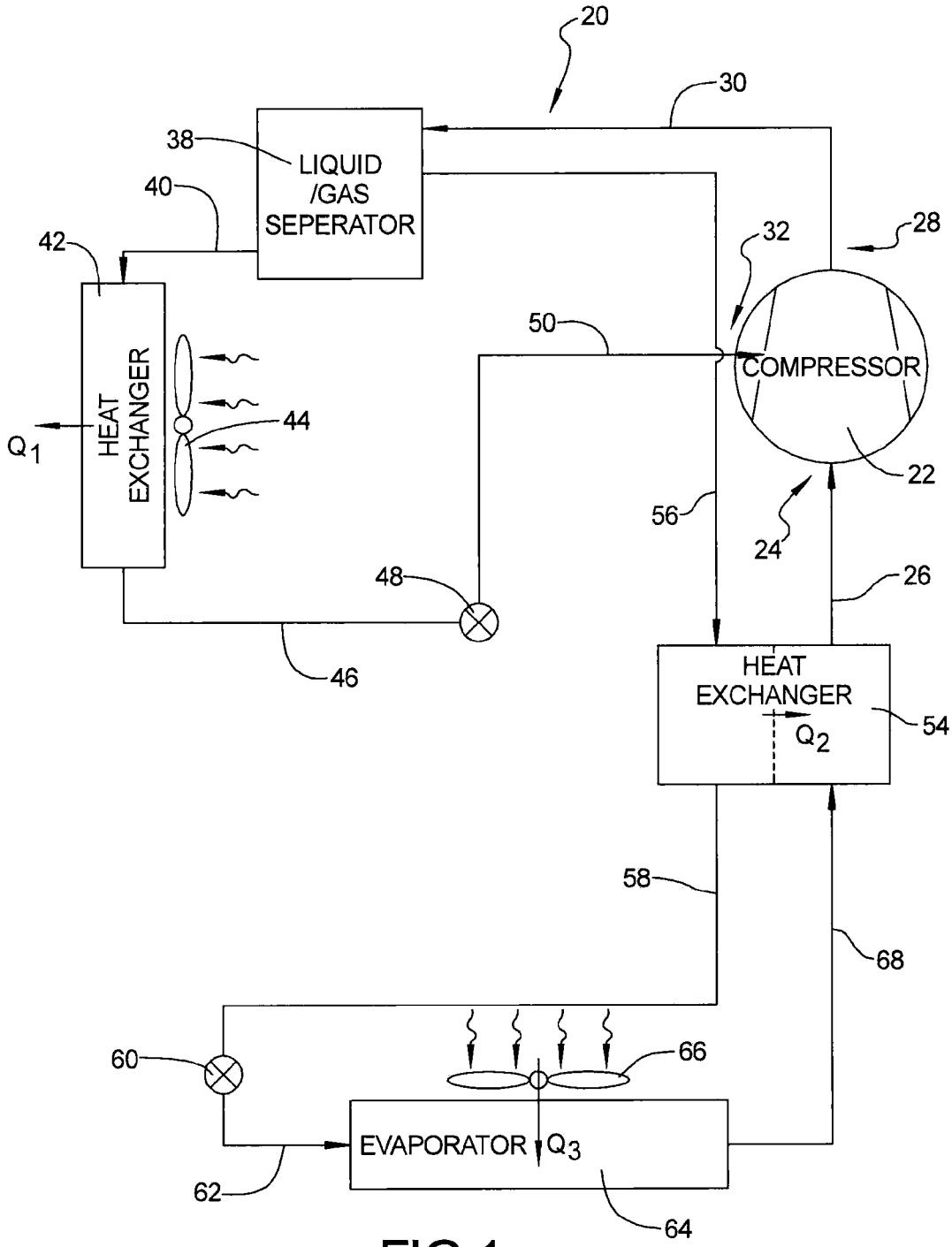
FIG. 1 is a schematic view of a refrigeration system according to the present teachings.

The following description is merely exemplary in nature and is not intended to limit the present disclosure, application, or uses. It should be understood that throughout the drawings, corresponding reference numerals (e.g., 20, 120, 220 and 30, 130, 230, etc.) indicate like or corresponding parts and features.

Referring to FIG. 1, a refrigeration system 20 according to the present teachings is shown. Refrigeration system 20 is a vapor-compression refrigeration system that is sealed and filled with a refrigerant. Refrigeration system 20 can be configured for a trans-critical refrigeration cycle wherein the refrigerant is at a temperature above its critical temperature during a part of the cycle, thus being in the vapor form regardless of the pressure, and is below its critical temperature in the other parts of the cycle, thereby enabling the refrigerant to be in liquid form. The trans-critical refrigerant can be $CO_2$ and other trans-critical refrigerants. It should be appreciated that non-trans-critical refrigerants can also be utilized, although all of the features and benefits of the present teachings may not be realized.

Figure 4:
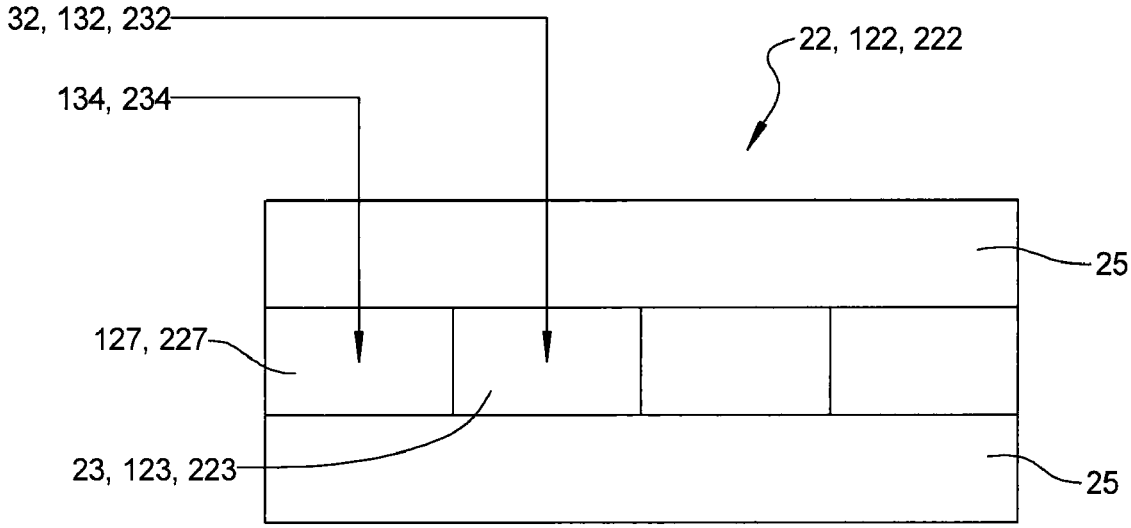
FIG. 4 is a schematic representation of intermediate-pressure locations formed by compression cavities in the compressor.

Refrigeration system 20 can include a compressor 22 which compresses the refrigerant flowing therethrough from a suction pressure to a desired discharge pressure. Compressor 22 can be a single-stage positive displacement compressor, such as a scroll compressor-type machine. Alternatively, other positive displacement-type compressors can be utilized, such as screw compressors, two-stage rotary compressors, and two-stage reciprocal compressors, although all of the features and benefits of the present teachings may not be realized. Compressor 22 can include an inlet suction port 24 that communicates with a suction line 26 which can supply refrigerant to the suction side of compressor 22. Compressor 22 can include an outlet/discharge port 28 that communicates with a discharge line 30 which receives compressed refrigerant from the discharge chamber of compressor 22. Compressor 22 can also include an intermediate-pressure port 32 that communicates with the compression cavities 23 (FIG. 4) of compressor 22 at a location that corresponds to an intermediate pressure between the discharge pressure and the suction pressure. Intermediate-pressure port 32 can thereby enable the supplying of a fluid to the compression cavities 23 of compressor 22 at an intermediate-pressure location. In refrigeration system 20, a cooling liquid is injected into the compression cavities at an intermediate-pressure location through intermediate-pressure port 32, as described below. The cooling liquid is in a single-phase liquid state throughout the refrigeration cycle. The cooling liquid can be a lubricant or oil, such as different types of mineral oil, or synthetic oils like, but not limited to, Polyolester (POE), Polylakyleneglycol (PAG), Alkylbenzene, Polyalfaolefin (PAO) oils. Upon certain conditions more exotic fluids, like water or Mercury, can be used.

Discharge line 30 communicates with a gas/liquid separator 38. Discharge line 30 can route the high-temperature, high-pressure fluid discharged by compressor 22 directly from discharge port 28 to separator 38. In other words, the fluid discharged from compressor 22 is not actively acted upon by any other device when flowing from discharge port 28 to separator 38 during nominal operation. Thus, the term "directly" as used herein in this context means the flow remains substantially unaltered between those two locations.

It should be appreciated, however, that other devices may be encountered in the flow path between the origin and destination devices, such as valves that can be used to isolate the various components of refrigeration system 20 for servicing. Such valves would not actively influence the flow therethrough during nominal operation of refrigeration system 20. The fluid discharged from compressor 22 includes both refrigerant, in vapor form, and the injected cooling liquid. Separator 38 can be essentially at the discharge pressure and temperature of compressor 22. The temperature within separator 38 is above the critical temperature and the refrigerant remains in vapor form regardless of the pressure within separator 38. The cooling liquid, however, maintains a single-phase form throughout the refrigeration cycle. Within separator 38, the refrigerant is separated from the cooling liquid which is utilized to cool the compressing process and absorb the heat of compression associated with compressor 22 compressing the refrigerant flowing therethrough. The separated high-temperature cooling liquid flows from separator 38 through a high-temperature cooling-liquid line 40 and into a heat exchanger 42. Within heat exchanger 42, heat $Q_1$ is extracted from the cooling liquid and transferred to ambient. A fan or blower 44 can facilitate the heat transfer by flowing ambient air across heat exchanger 42 in heat-conducting relation with the cooling liquid flowing therethrough. Alternatively, heat exchanger 42 could be a liquid-liquid heat exchanger, such as when refrigeration system 20 is utilized in conjunction with a heat pump system wherein the heat $Q_1$ can be used to heat water flowing through the heat pump system.

The cooling liquid exits heat exchanger 42 as a high-pressure, low-temperature liquid through a low-temperature cooling-liquid line 46. The high-pressure, low-temperature cooling liquid flows through a throttle device 48 which controls the flow of the cooling liquid and reduces the pressure of the cooling liquid to a pressure less than the discharge pressure but greater than the intermediate pressure of the compression cavities 23 that communicate with intermediate-pressure port 32. Throttle device 48 can take a variety of forms and can be dynamic, static, or quasi-static. For example, throttle device 48 can be an adjustable valve, a fixed orifice, a pressure regulator, and the like. When dynamic, a throttle device 48 can compensate for the load on compressor 22 and/or the cooling required to cool the compression process. The reduced-pressure cooling liquid flows from throttle device 48 to intermediate-pressure port 32 through an injection line 50 for injection into the compression cavities 23 that communicate with intermediate-pressure port 32.

The injection of cooling liquid into compressor 22 can extract the heat of compression created by compressing the refrigerant flowing therethrough. The heat can be discharged to the ambient as heat $Q_1$ by heat exchanger 42. The ability to remove the heat generated by the compression process with the injected cooling liquid can eliminate the need for a discharge gas cooler, heat exchanger, or condenser to reduce the discharge gas temperature prior to flowing through the rest of the refrigeration system. Thus, the use of injected liquid cooling can simplify the design of refrigeration system 20 and can enable most and possibly all of the heat of the refrigeration cycle to be absorbed by the injected cooling liquid and rejected through heat exchanger 42. The injection of the cooling liquid may enable the compression process to approach quasi-isothermal compression within compressor 22.

Within separator 38, the temperature remains above the critical temperature and, as a result, the refrigerant therein remains in vapor form. The high-temperature, high-pressure refrigerant vapor flows from separator 38 to a suction line heat exchanger 54 through high-temperature, high-pressure line 56. Within heat exchanger 54, heat $Q_2$ is transferred from the high-temperature, high-pressure refrigerant to low-temperature, low-pressure refrigerant flowing to the suction side of compressor 22. The transfer of heat $Q_2$ reduces the temperature of the high-temperature, high-pressure refrigerant and can thereby increase the heat absorbing capacity in the evaporator. The reduced temperature may remain above the critical temperature thereby resulting in the refrigerant being in vapor form regardless of the pressure therein. It may be possible, however, for the reduced temperature, depending upon the quantity of heat $Q_2$ transferred, to drop below the critical temperature and some limited condensing of the high-pressure refrigerant may occur.

A reduced-temperature, high-pressure line 58 directs the reduced-temperature, high-pressure refrigerant from heat exchanger 54 to a main throttle device 60. The refrigerant flowing through throttle device 60 expands and a further reduction in temperature and also a reduction in pressure occurs. Throttle device 60 can be dynamically controlled to compensate for a varying load placed on refrigeration system 20. Alternatively, throttle device 60 can be static. The refrigerant downstream of throttle device 60 can have a temperature below critical thereby resulting in a two-phase flow of refrigerant. A low-temperature, low-pressure line 62 directs the refrigerant flowing through throttle device 60 to evaporator 64. The two-phase, low-temperature, low-pressure refrigerant flows into evaporator 64 and absorbs heat $Q_3$ from the fluid flowing over evaporator 64. For example, heat $Q_3$ can be extracted from an air stream induced to flow over evaporator 64 by a fan or blower 66. The liquid portion of refrigerant within evaporator 64 boils off as heat $Q_3$ is absorbed. Once the liquid phase is boiled off, the temperature of the refrigerant increases and exits evaporator 64 through an intermediate-temperature, low-pressure line 68. Line 68 directs refrigerant into suction line heat exchanger 54 wherein the temperature of the refrigerant further increases, due to the transfer of heat $Q_2$, prior to flowing into compressor 22 through suction line 26.

In operation, the intermediate-temperature, low-pressure (suction pressure) refrigerant exiting suction line heat exchanger 54 is sucked into the compression cavities of compressor 22 through suction line 26 and suction port 24. The compression members 25 within compressor 22, such as the scrolls in the case of a scroll compressor, compress the refrigerant from the suction pressure to the discharge pressure. During the compressing process, significant amounts of cooling liquid are injected into the compression cavities 23 at an intermediate-pressure location through injection line 50. The specific quantity of cooling liquid injected into the compression cavities can vary based upon a multiplicity of factors. Such factors can include, but are not limited to, the demand placed on refrigeration system 20, the type of refrigerant utilized therein, the type and configuration of compressor 22, the efficiency of the compressor, the suction and discharge pressures, the heat capacity of the cooling liquid, and the ability of the selected cooling liquid to absorb the refrigerant at different pressures and temperatures. Injecting larger amounts of cooling liquid into the working chamber of the compressor allows the working process to approach an isothermal compression process. However, the cooling liquid injection process can also be associated with additional losses caused by increased throttling through ports, throttling of the cooling liquid before injection into the compression cavities, and parasitic recompression of refrigerant which dissolves in the cooling liquid under high pressure and is released at lower pressure. It is understood to those skilled in the art that for a given operational condition, selected working fluids, and compressor parameters there is an optimal amount of cooling liquid which can be injected in order to achieve the best possible overall performance of the refrigeration system. The quantity of cooling liquid injected into the compression cavities at the intermediate-pressure location can absorb most and possibly all of the heat from the compression process.

As a result, there may be no need to cool the refrigerant after discharge as the cooling can be achieved in heat exchanger 42 which extracts heat $Q_1$ from the cooling liquid flowing therethrough. Additionally, the injected cooling liquid significantly reduces the temperatures associated with the compression process, thereby relieving compressor 22 from excessive temperatures. Moreover, due to the heat absorption during the compression process, the compression process temperatures are less dependent on the temperature of the refrigerant entering the suction side of compressor 22 through suction port 24. This reduced dependency facilitates the use of a suction line heat exchanger 54 thereby enabling an improvement in the refrigeration cycle efficiency. Furthermore, the presence of the injected cooling liquid during the compression process can provide additional sealing to the gaps separating the compression cavities during the compression process. The increased sealing can reduce gas leakages through the gaps resulting in a reduction in the compression work needed to compress the refrigerant from a suction pressure to a discharge pressure. Thus, refrigeration system 20, according to the present teachings, can advantageously utilize the injection of cooling liquid into the compression cavities to improve the performance and/or efficiency of compressor 22 and/or refrigeration system 20.

Figure 2:
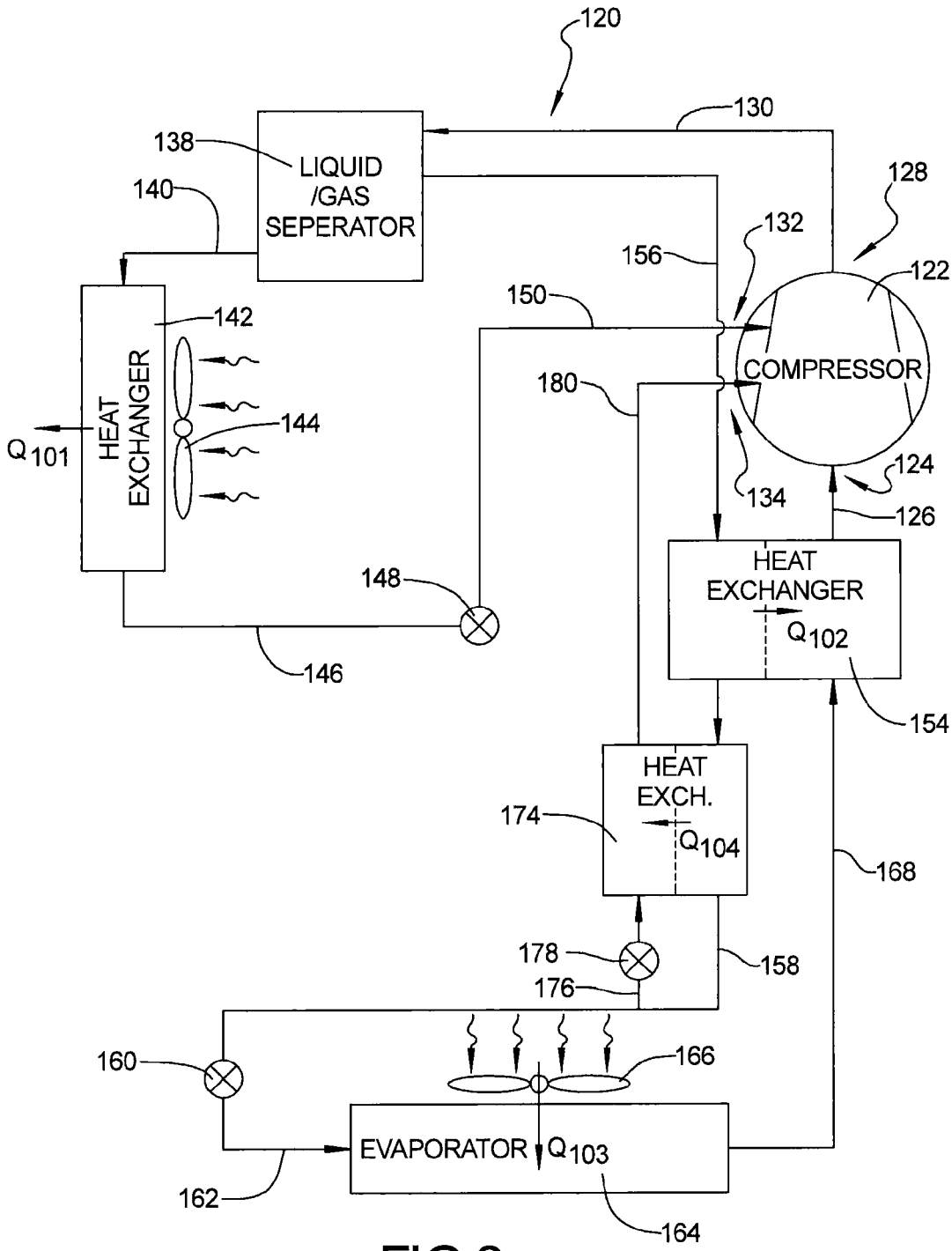
FIG. 2 is a schematic view of another refrigeration system according to the present teachings.

Referring now to FIG. 2, another refrigeration system 120 according to the present teachings is shown. Refrigeration system 120 is similar to refrigeration system 20, discussed above and shown in FIG. 1, with the addition of an economizer circuit. As such, refrigeration system 120 can include compressor 122 having inlet port 124 and discharge port 128 coupled to suction and discharge lines 126, 130. Compressor 122 can also include intermediate-pressure port 132 that communicates with injection line 150 to receive the cooling liquid. The discharge line 130 can communicate with a gas/liquid separator 138 that can separate the cooling liquid from the refrigerant and transfer the cooling liquid to heat exchanger 142 through line 140 to remove heat $Q_{101}$ from the cooling liquid. A fan or blower 144 can facilitate the heat removal. The cooling liquid can be injected into the compression cavities 123 at an intermediate-pressure location through line 146, throttle device 148, and injection line 150.

The addition of the economizer circuit can reduce the operational temperature of the refrigerant prior to flowing through the main expansion device thereby further increasing the capacity to absorb heat in the evaporator and increasing the cooling capacity of refrigeration system 120. With refrigeration system 120 being similar to refrigeration system 20, only the significant differences are discussed herein. It should be appreciated, however, that there may be additional differences between refrigeration system 120 and refrigeration system 20 that are not discussed herein.

The addition of the economizer circuit results in the injection of refrigerant in vapor form directly into the compression cavities at a location that corresponds to an intermediate pressure. Compressor 122 can have a second intermediate-pressure port 134 that can be used to inject the refrigerant vapor directly into the compression cavities 127 at an intermediate-pressure location. The use of separate intermediate pressure injection ports 132, 134 allows the refrigerant vapor injection to be kept separate from the cooling liquid injection. The use of separate injection ports can also facilitate control of the injection of the cooling liquid and the refrigerant vapor by reducing and/or eliminating the necessity for coordinating the injection pressures of the respective flows. Additionally, the potential for backflow of one of these flows into the other flow can also be reduced and/or eliminated. Thus, the use of separate injection ports can advantageously facilitate the injection of the cooling liquid and of the refrigerant vapor into the compression cavities at intermediate-pressure locations. Moreover, the use of separate injection ports can also allow the injection to occur at locations that correspond to different levels of intermediate pressure.

The economizer circuit can include an economizer heat exchanger 174 disposed in line with reduced-temperature, high-pressure line 158. A portion of the refrigerant flowing through line 158 downstream of a high-pressure side of economizer heat exchanger 174 can be routed through an economizer line 176, expanded in an economizer throttle device 178 and directed into a reduced-pressure side of economizer heat exchanger 174. The portion of the refrigerant flowing through economizer throttle device 178 is expanded such that the pressure is reduced along with the temperature and can absorb heat $Q_{104}$ from the reduced-temperature, high-pressure refrigerant flowing through the high-pressure side of heat exchanger 174. The transfer of heat $Q_{104}$ from the main refrigerant flow decreases the temperature prior to encountering main throttle device 160 and flowing onto evaporator 164 via line 162 thereby increasing the heat absorbing capacity of the refrigerant and improving the performance of evaporator 164. The refrigerant exits evaporator 164 through line 168 and flows into suction line heat exchanger 154 to absorb heat $Q_{102}$.

The expanded and heated refrigerant vapor exiting economizer heat exchanger 174 flows to second intermediate-pressure port 134 through vapor-injection line 180. The vapor is thereby injected into the compression cavities 127 at an intermediate-pressure location. Throttle device 178 can maintain the pressure in vapor-injection line 180 above the pressure at the intermediate-pressure location of the compression cavities 127 that communicate with second intermediate-pressure port 134. In this manner, throttle device 178 can facilitate the injection of refrigerant vapor directly into an intermediate-pressure location. Throttle device 178 can be a dynamic device or a static device, as desired, to provide a desired economizer effect. The injection of the refrigerant vapor at an intermediate pressure results in less energy required by the compressor to compress the injected vapor to discharge pressure thus resulting in a reduction in the specific work in the compressor which in turn results in improved system efficiency.

Thus, in refrigeration system 120, the benefits of the direct injection of a cooling liquid into the compression cavities 123 at an intermediate-pressure location along with the benefits of directly injecting refrigerant vapor into the compression cavities 127 at an intermediate-pressure location can both be realized. The combination of these two injection streams can advantageously improve the overall efficiency of refrigeration system 120 along with increasing the performance of compressor 122 and that of evaporator 164. The injection of the cooling liquid can reduce the impact of an increased temperature of the suction gas caused by the use of suction gas heat exchanger 154. Additionally, the lower temperature of the compressed refrigerant discharged by compressor 122 can facilitate the use of an economizer circuit to further reduce the temperature of the refrigerant prior to flowing through the main throttle device 160 and evaporator 164. The reduced discharge temperature can enable the economizer circuit to further reduce the refrigerant temperature to a temperature lower than that achieved with a refrigerant discharged at a higher temperature. Thus, the combination of a vapor-injection economizer circuit along with the cooling liquid injection can advantageously facilitate a more economical and efficient refrigeration system.

Figure 3:
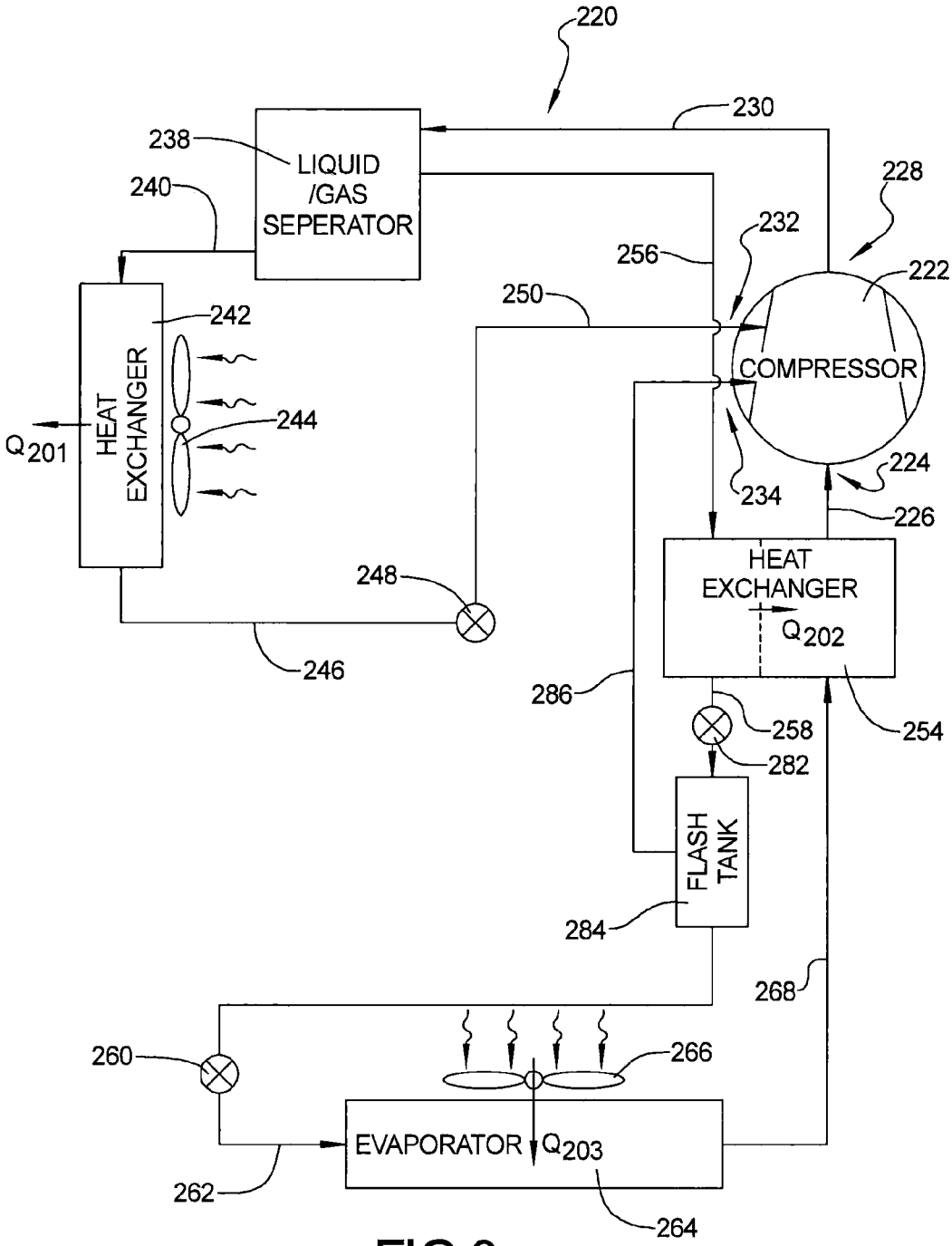
FIG. 3 is a schematic view of yet another refrigeration system according to the present teachings.

Referring now to FIG. 3, another refrigeration system 220 according to the present teachings is shown. Refrigeration system 220 is similar to refrigeration system 120 discussed above with reference to FIG. 2. As such, refrigeration system 220 can include a compressor 222 having a discharge port 228 connected to a discharge line 230 that routes the refrigerant and cooling liquid to a separator 238 for separation therein. The separated cooling liquid can flow through line 240 into heat exchanger 242 for removal of heat $Q_{201}$ therefrom. The reduced-heat cooling liquid can flow through line 246 and throttle device 248 to be injected into the pressure cavities 223 of compressor 222 at an intermediate-pressure location through injection line 250 and injection port 232. Fan 244 can be utilized to facilitate heat transfer in heat exchanger 242.

Refrigeration system 220 includes both cooling liquid injection and refrigerant vapor injection into the compression cavities 223, 227 of compressor 222 at intermediate-pressure locations. Refrigeration system 220, however, utilizes a different mechanization to inject refrigerant vapor. With refrigeration system 220 being similar to refrigeration system 120, only the significant differences are discussed herein. It should be appreciated, however, that there may be additional differences between refrigeration system 220 and refrigeration system 120 that are not discussed herein.

In refrigeration system 220, reduced-temperature, high-pressure line 258 includes an intermediate pressure throttle device 282 and a flash tank 284 downstream of suction line heat exchanger 254. The reduced-temperature, high-pressure refrigerant flowing through intermediate pressure throttle device 282 and into flash tank 284 is expanded thereby reducing the pressure and reducing the temperature to a sub-critical temperature and forming a two-phase refrigerant flow. Intermediate pressure throttle device 282 reduces the pressure of the refrigerant flowing therethrough to a pressure that is between the suction and discharge pressures of compressor 222 and is greater than the intermediate pressure in the compression cavities 227 that communicate with second intermediate-pressure port 234. Throttle device 282 can be dynamic or static. In flash tank 284 the gaseous refrigerant can be separated from the liquid refrigerant. The gaseous refrigerant can be routed to second intermediate-pressure port 234 through vapor-injection line 286 for injection into the compression cavities cavities 227 at an intermediate-pressure location. The liquid refrigerant in flash tank 284 can continue through line 258 and through main throttle device 260 and into evaporator 264. The refrigerant within evaporator 264 absorbs heat $Q_{203}$ and returns to gaseous form. The refrigerant flows, via line 268, from evaporator 264 to suction line heat exchanger 254, absorbs heat $Q_{202}$ and flows into the suction side of compressor 222 through suction line 226 and suction port 274.

Refrigeration system 220 utilizes both cooling liquid injection and vapor refrigerant injection to increase the efficiency and/or the cooling capacity of refrigeration system 220 and improving the performance of compressor 222. Thus, refrigeration system 220 can provide the benefits of both the injection of cooling liquid and the injection of refrigerant vapor into the pressure cavities at intermediate-pressure locations as described herein.

In the refrigeration systems according to the present teachings, the direct injection of the cooling liquid and/or the refrigerant vapor can be continuous or cyclic. For example, when the compressor is a single-stage compressor, the intermediate-pressure ports can be cyclically opened and closed in conjunction with the operation of the compression members therein. In a scroll compressor, the port(s) can be cyclically opened and closed due to the wrap of one of the scroll members blocking and unblocking an opening in the other scroll member as a result of the relative movement. In a screw compressor, the vanes of the screws can cyclically block and unblock the openings to the pressure cavities therein as a result of the movement of the screws. It should be appreciated that a continuous injection can be provided to single-stage compressors by maintaining an opening into the compression cavities at an intermediate-pressure location open at all times. Additionally, valves can be provided in the flow paths leading to the intermediate-pressure locations of the compression cavities and the valves operated in a manner that allows the injection of the fluid at a desired frequency.

In a two-stage compressor, such as a reciprocal or rotary compressor, the injection can be cyclical or continuous. In the two-stage compressors, the liquid injection and vapor injection can be directed to an intermediate-pressure chamber within which refrigerant discharged by the first stage is located prior to flowing into the second stage of the compressor. The flow paths to the intermediate-pressure chamber can be continuously open thereby allowing a continuous injection of the fluid streams. Valves can be disposed in the flow paths to provide a cyclic injection of the fluid streams. It should be appreciated that the injection of these two fluid streams can both be continuous, both be cyclic, or one can be cyclic while the other is continuous.

The refrigeration systems according to the present teachings have been described with reference to specific examples and configurations. It should be appreciated that changes in these configurations can be employed without deviating from the spirit and scope of the present teachings. Such variations are not to be regarded as a departure from the spirit and scope of the claims.

What is claimed is:

1. A refrigeration system comprising:

a compressor having a suction port, a discharge port, and a first intermediate-pressure port in communication with a first intermediate-pressure location of said compressor, said first intermediate-pressure location having a first intermediate pressure during operation of said compressor;

a refrigerant flowing through said compressor and compressed from a suction pressure to a discharge pressure greater than said suction pressure and having a nominal discharge temperature, said first intermediate pressure being greater than said suction pressure and less than said discharge pressure;

a single-phase cooling liquid received in said first intermediate-pressure port and injected into said first intermediate-pressure location and compressed to said discharge pressure and said nominal discharge temperature, said cooling liquid absorbing heat within said compressor caused by compression of said refrigerant and said cooling liquid;

a separator separating said refrigerant and said cooling liquid and operating at a temperature and pressure approximately equal to said discharge temperature and pressure;

a first heat exchanger receiving a generally refrigerant-free flow of said cooling liquid from said separator and removing heat to reduce a temperature of said cooling liquid;

a throttle device disposed in a flow path between said first heat exchanger and said first intermediate-pressure port and reducing a pressure of said cooling liquid to lower than said discharge pressure and greater than said first intermediate pressure of said first intermediate-pressure location of said compressor, wherein a fluid injected into said first intermediate-pressure location through said first intermediate-pressure port is substantially said single-phase cooling liquid and a pressure difference between said discharge pressure and said first intermediate pressure causes said single-phase cooling liquid to be injected into said first intermediate-pressure location;

a vapor-injection port on said compressor communicating with a second intermediate-pressure location of said compressor, said second intermediate pressure location having a second intermediate pressure during operation of said compressor greater than said suction pressure and less than said discharge pressure, and wherein a refrigerant stream flows out of said separator and a portion of said refrigerant stream is expanded and injected into said second intermediate pressure location of said compressor through said vapor-injection port in vapor form, wherein an entirety of said refrigerant stream is expanded through an expansion device and flows into a flash tank wherein a vapor portion of said refrigerant in said flash tank is injected into said compressor through said vapor-injection port.

2. The refrigeration system of claim 1, wherein said compressor is a scroll compressor having at least two compression members intermeshed therein with compression cavities formed therebetween.

3. The refrigeration system of claim 2, wherein said first intermediate-pressure location is a compression cavity formed between said compression members.

4. The refrigeration system of claim 1, wherein said compressor is a single-stage compressor.

5. The refrigeration system of claim 1, wherein said throttle device actively controls flow of said cooling liquid through said flow path.

6. The refrigeration system according to claim 1, wherein said refrigerant is a multi-phase, trans-critical refrigerant and said nominal discharge temperature is greater than a critical temperature of said refrigerant.

7. The refrigeration system of claim 6, wherein said refrigerant and said cooling liquid exit said discharge port and flow directly to said separator.

8. The refrigeration system of claim 1, wherein said single-phase cooling liquid is injected into said first intermediate-pressure location solely due to said pressure difference.

9. A refrigeration system comprising:

a compressor having a suction port, a discharge port, and a first intermediate-pressure port in communication with a first intermediate-pressure location of said compressor, said first intermediate-pressure location having a first intermediate pressure during operation of said compressor;

a refrigerant flowing through said compressor and compressed from a suction pressure to a discharge pressure greater than said suction pressure and having a nominal discharge temperature, said first intermediate pressure being greater than said suction pressure and less than said discharge pressure;

a single-phase cooling liquid received in said first intermediate-pressure port and injected into said first intermediate-pressure location and compressed to said discharge pressure and said nominal discharge temperature, said cooling liquid absorbing heat within said compressor caused by compression of said refrigerant and said cooling liquid;

a separator separating said refrigerant and said cooling liquid and operating at a temperature and pressure approximately equal to said discharge temperature and pressure;

a first heat exchanger receiving a generally refrigerant-free flow of said cooling liquid from said separator and removing heat to reduce a temperature of said cooling liquid;

a throttle device disposed in a flow path between said first heat exchanger and said first intermediate-pressure port and reducing a pressure of said cooling liquid to lower than said discharge pressure and greater than said first intermediate pressure of said first intermediate-pressure location of said compressor, wherein a fluid injected into said first intermediate-pressure location through said first intermediate-pressure port is substantially said single-phase cooling liquid and a pressure difference between said discharge pressure and said first intermediate pressure causes said single-phase cooling liquid to be injected into said first intermediate-pressure location;

a vapor-injection port on said compressor communicating with a second intermediate-pressure location of said compressor, said second intermediate pressure location having a second intermediate pressure during operation of said compressor greater than said suction pressure and less than said discharge pressure, and wherein a refrigerant stream flows out of said separator and a portion of said refrigerant stream is expanded and injected into said second intermediate pressure location of said compressor through said vapor-injection port in vapor form, wherein said refrigerant stream flows through a second heat exchanger in heat-transferring relation with said expanded portion of said refrigerant prior to said expanded portion being separated from said refrigerant stream.

10. The refrigeration system of claim 9, wherein said compressor is a scroll compressor having at least two compression members intermeshed therein with compression cavities formed therebetween, and wherein said first intermediate-pressure location is a compression cavity formed between said compression members.

11. The refrigeration system of claim 9, wherein said compressor is a single-stage compressor.

12. The refrigeration system of claim 9, wherein said throttle device actively controls flow of said cooling liquid through said flow path.

13. The refrigeration system according to claim 9, wherein said refrigerant is a multi-phase, trans-critical refrigerant and said nominal discharge temperature is greater than a critical temperature of said refrigerant.

14. The refrigeration system of claim 13, wherein said refrigerant and said cooling liquid exit said discharge port and flow directly to said separator.

15. The refrigeration system of claim 9, wherein said single-phase cooling liquid is injected into said first intermediate-pressure location solely due to said pressure difference.

16. A refrigeration system comprising:

a compressor having a suction port, a discharge port, and at least two intermediate-pressure ports each communicating with a different intermediate-pressure location of said compressor, said compressor compressing a refrigerant and a single-phase cooling liquid flowing therethrough to a discharge pressure greater than a suction pressure;

a separator separating said refrigerant and said cooling liquid;

a first flow path communicating with said separator and a first one of said intermediate-pressure ports and through which a first stream of generally refrigerant-free cooling liquid from said separator flows and is injected into a first intermediate-pressure location of said compressor, said first intermediate-pressure location having a first intermediate pressure during operation of said compressor greater than said suction pressure and less than said discharge pressure, and said cooling liquid absorbing heat within said compressor caused by said compression; and a second flow path communicating with said separator and a second one of said intermediate-pressure ports and through which a second stream of generally cooling-liquid-free vapor refrigerant flows and is injected into a second intermediate-pressure location of said compressor, said second intermediate-pressure location having a second intermediate pressure during operation of said compressor greater than said suction pressure and less than said discharge pressure, wherein said first flow path includes a first heat exchanger and a first throttle device, said first heat exchanger removing heat from said first stream thereby reducing a temperature of said first stream, and said first throttle device reducing a pressure of said reduced first stream to lower than said discharge pressure and greater than said first intermediate pressure of said first intermediate-pressure location thereby injecting said first stream into said first intermediate-pressure location due to a pressure difference between said discharge pressure and said first intermediate pressure;

a third flow path extending from said separator to said suction port, said third flow path being a main refrigerant flow path and receiving a third stream of generally cooling-liquid-free refrigerant from said separator, said second flow path communicating with said third flow path such that said second stream is a minority portion of said third stream;

a pressure-reducing device disposed in said third flow path reducing a pressure of said third stream to less than said discharge pressure and greater than said second intermediate pressure of said second intermediate-pressure location;

a flash tank in said third steam downstream of said pressure-reducing device, said flash tank operable to allow a portion of said third stream to flash into a two-phase stream of liquid and vapor refrigerant, said second flow path extending from said flash tank to said second intermediate-pressure port such that said second stream is refrigerant vapor from said flash tank and is injected into said second intermediate-pressure location, and a majority portion of said third stream exits said flash tank through said third flow path and can include both liquid and vapor refrigerant.

17. The refrigeration system of claim 16, wherein said separator directly receives said refrigerant and said cooling liquid discharged by said compressor and operates at a temperature and pressure approximately equal to a discharge temperature of said compressor and said discharge pressure.

18. The refrigeration system of claim 16, wherein said compressor is a scroll compressor having at least two compression members intermeshed therein with compression cavities formed therebetween.

19. The refrigeration system of claim 18, wherein said first and second intermediate-pressure locations are each a compression cavity formed between said compression members.

20. The refrigeration system of claim 16, wherein said compressor is a single stage compressor.

21. The refrigeration system according to claim 16, wherein said refrigerant is a multi-phase, trans-critical refrigerant and said compressor discharges said refrigerant at a nominal discharge temperature greater than a critical temperature of said refrigerant.

22. A refrigeration system comprising:

a compressor having a suction port, a discharge port, and at least two intermediate-pressure ports each communicating with a different intermediate-pressure location of said compressor, said compressor compressing a refrigerant and a single-phase cooling liquid flowing therethrough to a discharge pressure greater than a suction pressure;

a separator separating said refrigerant and said cooling liquid;

a first flow path communicating with said separator and a first one of said intermediate-pressure ports and through which a first stream of generally refrigerant-free cooling liquid from said separator flows and is injected into a first intermediate-pressure location of said compressor, said first intermediate-pressure location having a first intermediate pressure during operation of said compressor greater than said suction pressure and less than said discharge pressure, and said cooling liquid absorbing heat within said compressor caused by said compression;

a second flow path communicating with said separator and a second one of said intermediate-pressure ports and through which a second stream of generally cooling-liquid-free vapor refrigerant flows and is injected into a second intermediate-pressure location of said compressor, said second intermediate-pressure location having a second intermediate pressure during operation of said compressor greater than said suction pressure and less than said discharge pressure;

a third flow path extending from said separator to said suction port, said third flow path being a main refrigerant flow path and receiving a third stream of generally cooling-liquid-free refrigerant from said separator, said second flow path extending from said third flow path to said second intermediate-pressure port and said second stream is a minority portion of said third stream;

a first heat exchanger through which said second and third flow paths extend in heat-transferring relation, said first heat exchanger transferring heat from said third stream to said second stream;

a pressure-reducing device disposed in said second flow path reducing a pressure of said second stream to less than said discharge pressure and greater than said second intermediate pressure of said second intermediate-pressure location thereby injecting said second stream into said second intermediate-pressure location;

a main throttle device disposed in said third flow path downstream of a location where said second flow path extends from said third flow path, said main throttle device reducing a pressure of said third stream flowing therethrough;

an evaporator in said third flow path downstream of said main throttle device, said evaporator transferring heat into said third stream flowing therethrough; and a second heat exchanger disposed in first and second sections of said third flow path with said first and second sections in heat-transferring relation with one another through said second heat exchanger, said first section being upstream of said first heat exchanger such that said third stream flowing through said first section flows through said second heat exchanger prior to flowing through said first heat exchanger, said second section being downstream of said evaporator and upstream of said suction port, and said second heat exchanger transferring heat from said third stream flowing through said first section into said third stream flowing through said second section.

23. The refrigeration system of claim 22, wherein said compressor is a scroll compressor having at least two compression members intermeshed therein with compression cavities formed therebetween.

24. The refrigeration system of claim 23, wherein said first and second intermediate-pressure locations are each a compression cavity formed between said compression members.

25. The refrigeration system of claim 22, wherein said compressor is a single stage compressor.

26. The refrigeration system according to claim 22, wherein said refrigerant is a multi-phase, trans-critical refrigerant and said compressor discharges said refrigerant at a nominal discharge temperature greater than a critical temperature of said refrigerant.

27. The refrigeration system of claim 22, wherein said separator directly receives said refrigerant and said cooling liquid discharged by said compressor and operates at a temperature and pressure approximately equal to a discharge temperature of said compressor and said discharge pressure.

28. A refrigeration system comprising:

a compressor having a suction port, a discharge port, and at least two intermediate-pressure ports each communicating with a different intermediate-pressure location of said compressor, said compressor compressing a refrigerant and a single-phase cooling liquid flowing therethrough to a discharge pressure greater than a suction pressure;

a separator separating said refrigerant and said cooling liquid;

a first flow path communicating with said separator and a first one of said intermediate-pressure ports and through which a first stream of generally refrigerant-free cooling liquid from said separator flows and is injected into a first intermediate-pressure location of said compressor, said first intermediate-pressure location having a first intermediate pressure during operation of said compressor greater than said suction pressure and less than said discharge pressure, and said cooling liquid absorbing heat within said compressor caused by said compression;

a second flow path communicating with said separator and a second one of said intermediate-pressure ports and through which a second stream of generally cooling-liquid-free vapor refrigerant flows and is injected into a second intermediate-pressure location of said compressor, said second intermediate-pressure location having a second intermediate pressure during operation of said compressor greater than said suction pressure and less than said discharge pressure;

a third flow path extending from said separator to said suction port, said third flow path being a main refrigerant flow path and receiving a third stream of generally cooling-liquid-free refrigerant from said separator, said second flow path communicating with said third flow path such that said second stream is a minority portion of said third stream;

a first pressure-reducing device disposed in said third flow path reducing a pressure of said third stream to less than said discharge pressure and greater than said second intermediate pressure of said second intermediate-pressure location; and a flash tank in said third steam downstream of said first pressure-reducing device, said flash tank operable to allow a portion of said third stream to flash into a two-phase stream of liquid and vapor refrigerant, said second flow path extending from said flash tank to said second intermediate-pressure port such that said second stream is refrigerant vapor from said flash tank that is injected into said second intermediate-pressure location, and a majority portion of said third stream exits said flash tank through said third flow path and can include both liquid and vapor refrigerant.

29. The refrigeration system of claim 28, further comprising:

a second pressure-reducing device disposed in said third flow path downstream of said flash tank, said second pressure-reducing device reducing a pressure of said third stream flowing therethrough;

an evaporator in said third flow path downstream of said second pressure-reducing device, said evaporator transferring heat into said third stream flowing therethrough; and a heat exchanger disposed in first and second sections of said third flow path with said first and second sections in heat-transferring relation with one another through said heat exchanger, said first section being upstream of said first pressure-reducing device such that said third stream flowing through said first section flows through said heat exchanger prior to flowing through said evaporator, said second section being downstream of said evaporator and upstream of said suction port, and said heat exchanger transferring heat from said third stream flowing through said first section into said third stream flowing through said second section.

30. The refrigeration system of claim 28, wherein said compressor is a scroll compressor having at least two compression members intermeshed therein with compression cavities formed therebetween, and wherein said first and second intermediate-pressure locations are each a compression cavity formed between said compression members.

31. The refrigeration system of claim 28, wherein said compressor is a single stage scroll compressor.

32. The refrigeration system according to claim 28, wherein said refrigerant is a multi-phase, trans-critical refrigerant and said compressor discharges said refrigerant at a nominal discharge temperature greater than a critical temperature of said refrigerant.

33. The refrigeration system of claim 28, wherein said separator directly receives said refrigerant and said cooling liquid discharged by said compressor and operates at a temperature and pressure approximately equal to a discharge temperature of said compressor and said discharge pressure.

* * * * *

UNITED STATES PATENT AND TRADEMARK OFFICE

CERTIFICATE OF CORRECTION

PATENT NO. : 8,181,478 B2
APPLICATION NO. : 11/541951
DATED : May 22, 2012
INVENTOR(S) : Kirill Ignatiev It is certified that error appears in the above-identified patent and that said Letters Patent is hereby corrected as shown below:

| | |
|---|---|
| Column 7, Line 48 | "cavities cavities 227" should be --cavities 227--. |
| Column 11, Line 50 | "steam" should be --stream--. |
| Column 14, Line 12 | "steam" should be --stream--. |

Signed and Sealed this
Eighteenth Day of September, 2012

David J. Kappos

David J. Kappos
*Director of the United States Patent and Trademark Office*